United States Patent [19]

Sudoh et al.

[11] Patent Number: 4,553,416

[45] Date of Patent: Nov. 19, 1985

[54] DRY TYPE CONTINUOUS WIRE DRAWING PROCESS

[75] Inventors: Chuzoh Sudoh; Hyoji Hagita; Satoru Fujii, all of Amagasaki, Japan

[73] Assignee: Sumitomo Metal Industries, Ltd., Osaka, Japan

[21] Appl. No.: 505,843

[22] Filed: Jun. 20, 1983

[51] Int. Cl.[4] ..... B21C 9/00; B21C 9/02; B21C 43/04

[52] U.S. Cl. ..... 72/40; 72/42; 72/43

[58] Field of Search ..... 72/40, 42, 43, 44, 45, 72/53, 274

[56] References Cited

U.S. PATENT DOCUMENTS

| | | | |
|---|---|---|---|
| 2,239,044 | 4/1941 | Leighton | 72/41 |
| 2,318,614 | 5/1943 | Leonard | 72/42 |
| 2,319,393 | 5/1943 | Epstein et al. | 72/42 |
| 2,883,039 | 4/1959 | Smollinger et al. | 72/43 |
| 3,080,962 | 3/1963 | Fleischmann et al. | 72/41 X |
| 3,145,832 | 8/1964 | Case | 72/43 X |
| 3,413,832 | 12/1968 | Lang et al. | 72/42 |
| 3,763,680 | 10/1973 | Godfrey et al. | 72/43 |
| 3,841,126 | 10/1974 | Minami et al. | 72/45 |

FOREIGN PATENT DOCUMENTS

| | | | |
|---|---|---|---|
| 57-171515 | 10/1982 | Japan . | |
| 206516 | 12/1982 | Japan | 72/44 |
| 723858 | 2/1955 | United Kingdom . | |
| 894048 | 4/1962 | United Kingdom . | |
| 1095729 | 12/1967 | United Kingdom . | |
| 1320133 | 6/1973 | United Kingdom . | |
| 1423826 | 2/1976 | United Kingdom . | |
| 2057321 | 4/1981 | United Kingdom | 72/41 |

*Primary Examiner*—E. Michael Combs

*Attorney, Agent, or Firm*—Burns, Doane, Swecker and Mathis

[57] ABSTRACT

Herein disclosed is a dry type continuous wire drawing process which can retain satisfactory working circumstances while eliminating the problem of disposal of waste liquids. The wire drawing process includes the steps of descaling a wire to be drawn, coating the descaled wire with a lubricant, and drawing the lubricant-coated wire through a drawing die. The descaling step is conducted in a mechanical manner. At the lubricant coating step, the descaled wire is once coated with lime powder and then with metallic soap powder. Thus. the three steps recited are conducted under dry and continuous conditions. At the lubricant coating step, the lime-coated wire may be coated with powder of sodium stearate before it is coated with the metallic soap.

7 Claims, 3 Drawing Figures

DRY TYPE CONTINUOUS WIRE DRAWING PROCESS

BACKGROUND OF THE INVENTION

1. Field of the Invention

The present invention relates to a dry type wire drawing process for continuously drawing a wire rod or a steel bar (which will be conveniently referred to as a "wire").

2. Description of the Prior Art

In a general example of a secondary working operation for a wire to be cold-forged into bolts or nuts, the wire is pickled so that it may be descaled. Next, the descaled wire is treated with a lubricant and is then subjected to a primary drawing operation. After that, the drawn wire is annealed to spheroidize the cementite so as to give a high cold-forgeability. The wire once drawn is pickled and treated with a lubricant at a second stage and is then secondarily drawn by the so-called "skin pass".

In the prior art, the pickling treatment, the surfacing treatment for lubrication, and the lubricating treatment are conducted by the batch-type process, by which a coiled wire is hung by means of a C-shaped hook so that it may be consecutively immersed in and transferred to and from the respective treating liquid baths. As a result, the batch-type process suffers from problems: that the productivity is so low as to raise the cost; that an additional cost for disposing the respective treating liquids is high because the environmental pollution has to be considered; that satisfactory working circumstances are not always provided because the treatments are of the wet type; and that inspection of the product over the whole length is difficult.

Here, liquid zinc phosphate is used as lubrication surfacer of the prior art, and a liquid which is prepared by dissolving either powdered metallic soap or a mixture of lime and metallic soap is used as the lubricant. However, the cost for this process is high. Moreover, the wire to be cold-forged is subjected to the surfacing treatment with a lubricant, i.e., zinc phosphate having an excellent lubricity although this lubricant is expensive, because the lubricant used for the drawing treatment effects, as it is, the lubrication required for the cold-forging treatment.

For the more and more severe requirement for qualities in recent years, on the other hand, flaw detection and repair of the drawn wire become more and more important treatments. Generally speaking, however, the in-line flaw detection and the automatic wire repair are so remarkably difficult that they have been conducted exclusively off-line. Once the drawn wire has been taken up, more specifically, its flaw is either subjected, at a finishing step, to detection by the use of a nondestructive or destructive flaw detector or visually detected by human eyes if it is located in the surface. Then, the flawed portion is manually repaired by means of a grinder or the like. Despite of this fact, the off-line method of the prior art is so inefficient and uneconomical that it is tremendously troublesome, that spaces for the facilities are additionally required, and that the transporting works are complicated.

Upon elimination of the aforementioned surface flaw, on the other hand, it is being recently developed that the flawed surface portion is cut only a predetermined length all over the circumference, in view of the fact that the yield is reduced by the general example of the prior art because the wire is either peeled off its whole length over the whole circumference by means of a die or cut by means of a cutting tool on the same principle as that of a lathe. Despite this development, reduction in the yield cannot be avoided because the wire is cut all over the circumference even partially of the longitudinal direction.

We, the Inventors, have succeeded in completing the present invention by earnestly repeating the experiments and researches while amining at, as has been described hereinbefore: a first target that the batch-type treating process should be replaced by the continuous drawing process because it has a problem in efficiency and so on; a second target that the dry type process is desired from the standpoint that the wet type process cannot provide satisfactory working curcumstances but raises the cost for the facilities so that it is not acceptable; and a third target that the steps from the flaw detection to the repair are made in-line.

SUMMARY OF THE INVENTION

It is, therefore, an object of the present invention to provide dry type continuous wire drawing process which is enabled to retain satisfactory working circumstances, while eliminating the problem of disposal of waste liquids, and to enhance the productivity to reduce the cost by continuously conducting the wire drawing treatment.

According to a feature of the present invention, there is provided a dry type continuous wire drawing process comprising: the step of descaling a wire to be drawn; the step of coating the descaled wire with a lubricant; and the step of drawing the lubricant-coated wire through a drawing die, wherein the improvement resides: in that the descaling step includes a mechanical sub-step of conducting the descaling treatment in a mechanical manner; and in that the lubricant-coating step includes a sub-step of coating the descaled wire with lime powder, and a sub-step of coating the lime-coated wire with metallic soap powder, whereby all the three major steps are conducted under dry and continuous conditions.

BRIEF DESCRIPTION OF THE DRAWINGS

Other objects, features and advantages of the present invention will become more apparent from the following description taken in conjunction with the accompanying drawings, in which.

DESCRIPTION OF THE PREFERRED EMBODIMENTS

Figure 1:
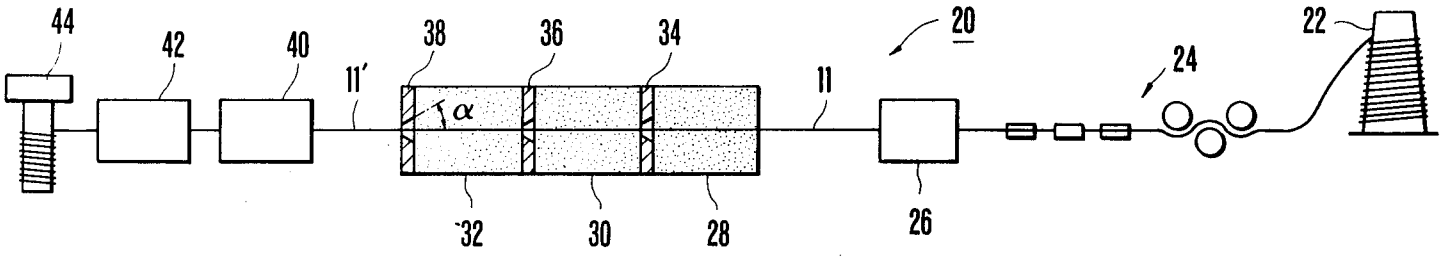
FIG. 1 is a schematic view showing the arrangement of a wire drawing machine by which a dry type continuous wire drawing process according to the present invention is put into practice.

Referring first to FIG. 1, a wire 11 to be drawn is held in such a state on a pay-off stand 22 of a dry type continuous wire drawing machine 20 that it is wound thereon in a coiled shape, and is then fed to a drawing line. This feed is performed by guiding the leading end of the wire 11, which has been sharpened at a preceding step. The wire 11 thus unwound from the pay-off stand 22 is guided to run via a leveler 24 of vertical and horizontal (i.e., V-H) construction through a shot blaster 26 acting as the descaling means. In this shot blaster 26, suitable shot particles and their suitable shooting density are so set that an oxide film and so on may be peeled from the surface of the wire 11.

Next, the wire 11 is guided through a lubricant surfacer bath 28, a reinforcing lubricant bath 30 and a pre-die lubricant bath 32 which are arranged in tandem in the recited order and equipped with at their respective exits with a lubricant surfacer applying die 34, a reinforcing lubricant applying die 36 and a wire drawing die 38. These baths 28 to 32 are respectively filled up with lime powder as the lubricating surfacer, the reinforcing lubricant such as sodium stearate, and the pre-die lubricant such as a mixture of calcium or sodium stearate and slaked lime.

Figure 2:
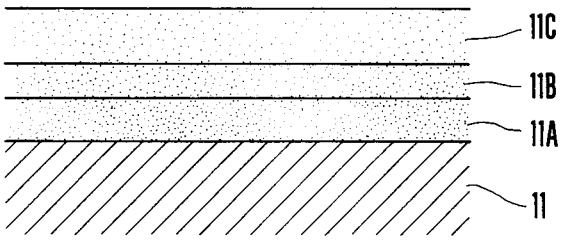
FIG. 2 is an enlarged schematic section showing the construction of the lubricant layers of a wire to be drawn by the dry type continuous wire drawing process of the present invention.

The wire 11 passes through the lubricating surfacer bath 28 after it has been descaled, and is then guided through the lubricating surfacer applying die 34. During this passage, the wire 11 is coated with the lime powder 11A, as shown in FIG. 2. Then, since the bore diameter of the applying die 34 is predetermined at a value slightly larger than that of the target wire 11, both the lime powder 11A, which has just been applied, and the surrouding lime powder are in turn squeezed between the bore wall and the surface of the wire 11, while this wire 11 is running through the bore of the applying die 34, so that the lime powder 11A is pressure-applied to the surface of the wire 11. The lime powder 11A functions as the surfacer of lubricants 11B and 11C, as shown in FIG. 2, and to enhance the coating properties of both the reinforcing lubricant 11B and the pre-die lubricant 11C, which are to be subsequently applied. On the other hand, not only the slaked lime but also quick lime can be used as the lime powder. However, the slaked lime is preferred because hygroscopicity of the quick lime frequently raises a handling problem. The particle size of the lime powder is desired to be not smaller than 2 microns.

Next, the wire 11 passes through the reinforcing lubricant bath 30 and the reinforcing lubricant applying die 36. During these passages, the reinforcing lubricant 11B is pressure-applied, as in the aforementioned case of the lime powder 11A, to the surface layer of the lime powder 11A which has already been pressure-applied to the wire 11. Sodium stearate is used as the reinforcing lubricant 11B. If the sodium stearate used has a particle size not larger than 2 microns, its coating density is reduced by the so-called "tunnel effect" resulting from the passage through the fluffy powder so that the lubricating effect becomes insufficient. It is, therefore, preferable that the particle size of the sodium stearate be at least 2 microns.

On the other hand, the application of the reinforcing lubricant 11B should preferably be performed but can be omitted in the case of drawing a wire having a low strength.

After that, the wire 11 is guided into the pre-die lubricant bath 32. This bath 32 is filled up with a mixed lubricant of calcium or sodium stearate and lime as that pre-die lubricant 11C, which is to be pressure-applied to the surface layer of the wire 11. Next, the wire 11 is subjected to a drawing treatment at a predetermined working ratio by the action of the drawing die 38.

Here, with closer refenece to FIG. 2, the lubricating surface 11A, the reinforcing surfacer 11B and the pre-die lubricant 11C will be described in more detail in the following. The lubricating surfacer 11A is slaked lime having a particle size not smaller than 2 microns, as has been described hereinbefore. On the other hand, the reinforcing lubricant 11B is selected from the so-called "metallic soap" group consisting of calcium, sodium, zinc and aluminum stearate. Moreover, the pre-die lubricant 11C is a mixed one of the calcium or sodium stearate of the metallic soap, and slaked lime. The mixing ratio of the stearate and the remainder, i.e., and the slaked lime is usually 50 to 80% (in weight) for the former and 20 to 50% for the latter and can change the melting point of the lubricant 11C as a whole if it is varied. On the other hand, the coating density is set at at least 5 $g/m^2$ for the lubricating surfacer 11A, at least 1 $g/m^2$ for the reinforcing lubricant 11B, and at least 2 $g/m^2$ for the pre-die lubricant 11C and has to be totally set at at least 10 $g/m^2$.

In the embodiment thus far described, the dies 34, 36 and 38 are exemplified by bored ones but may be replaced by roller ones.

The wire 11' having been drawn is guided to enter a flaw detector 40 such as a rotary probe type eddy current flaw detector, as shown in FIG. 1. The wire 11' has not only its intrinsic material flaw but also a handling flaw and/or a die flaw which has been caused by the seizure or the like when the wire 11' is passing through the drawing die 38. Thus, the flaw of any type is detected continuously in-line by the flaw detector 40 so that the flawed portion may be removed by a flaw remover 42 in response to a flaw detection signal coming from that detector 40.

The wire 11' thus having been subjected to a series of treatments is wound up by the action of a take-up roller 44. The wire 11' is then transferred to a subsequent step for a secondary drawing operation. However, the wire 11' may be shipped without any treatment as a wire to be cold-forged, if it is used for applications in which no strict quality requirement is made as to the surface skin and so on.

Figure 3:
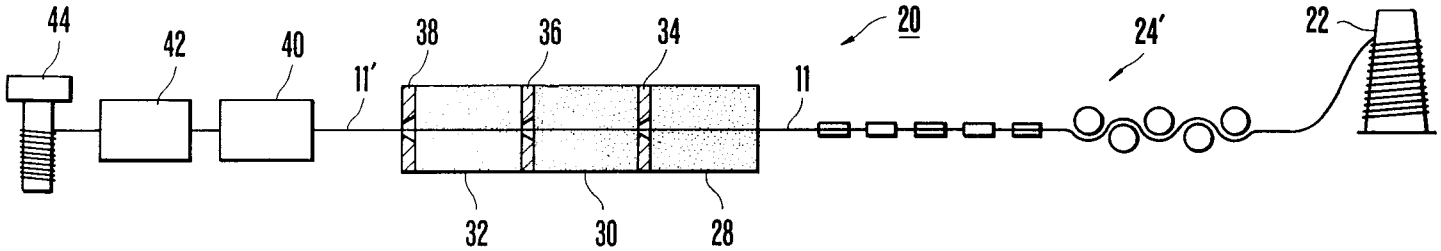
FIG. 3 is similar to FIG. 1 but shows another embodiment of the present invention.

In the foregoing embodiment, the shot blaster 26 is used as the mechanical descaler for mechanically effecting the descaling operation. As shown in FIG. 3, on the contrary, the shot blaster 26 may be replaced by a roll bender 24'. This roll bender 24' has a function to repeatedly bend and elongate the wire 11' so that the scale layer may be fissured and peeled off, and acts as the leveler. The drawing weight percentage of the roll bender 24' is suitably selected. Incidentally, it is quite natural that the roll bender 24' and the shot blaster 26 may be used together as the mechanical descaler.

Here, a major feature of the present invention will be described in detail, as compared with the prior art. The present invention is of the dry type and performs the continuous drawing treatment. As is different from the conventional batch-type treating system which is inefficient and uneconomical, the continuous wire drawing system according to the present invention can enjoy a line speed as high as about 120 m/min., for example, so that the treating efficiency can be remarkably improved. On the other hand, if the flaw detector 40 and the flaw remover 42 are disposed on the continuous wire drawing line, quick treatments can be achieved, as is different from the batch-type system of the prior art in which many flaw detecting and repairing troubles are incorporated.

The present invention adopts the dry type in the case of the continuous wire drawing treatment. There is known to the prior art the concept per se of disposing a dry type pre-die lubricant upstream of the drawing die so that the wire may be drawn after it has been coated which that lubricant. On the contrary, however, it is not before the present invention that the treatment with the lubricating surfacer and, if necessary, the treatment with the reinforcing lubricant are conducted in dry manners. According to the present invention, moreover, the lime powder is used as the lubricating surfacer. In the prior art, zinc phosphate, which is expensive but is excellent in lubricating properties, is used as the lubricating surfacer. The zinc phosphate cannot be applied to the present invention which resorts to the dry type treatment, because it is liquid. Therefore, the lime powder is used in place of the zinc phosphate. The drawn wire, which is prepared by the surfacing treatment with the lubricant of the lime powder and by the dry type lubrication, is not always superior, as for the conditions of the surface skin, to the drawn wire which is prepared by the wet type lubrication, which is conducted as a representative of the prior art by a series of the pickling step→the surfacing step with zinc phosphate→the lubricating step with the mixture of lime and metallic soap. Despite this fact, the primary drawing treatment is a preliminary one preceding a secondary drawing treatment, and the conditions or the like of the surface skin can be improved before long by the secondary drawing step. Here, the simplified process according to the present invention can sufficiently achieve the aforementioned objects and is rather rational.

The best advantage that can be attained thanks to the dry type system is the abilities of shortening the line length and reducing the cost for the facilities. For example, if it is intended to conduct the continuous treatment by the wet type system, the surfacing treatment with the lubricant and the lubricating treatment require a considerable reaction time for attaining a predetermined film thickness so that accordingly elongated facilities are indispensable. On the contrary, the dry type system can enjoy the aforementioned advantage because it requires at most the small-sized baths and the dies therefor. Moreover, the working circumstances are improved because no acid is used. Generally speaking, still moreover, either the sodium stearate or the mixture of lime and calcium stearate is of powdered type and is dissolved according to the prior art before it is used for the wet type treatment. In the dry type system, on the contrary, the above-specified material may be used, as it is, so that it is remarkably excellent in handling.

As has been described hereinbefore, the process of the present invention can conduct the drawing operations remarkably economically partly because these operations are performed in dry and continuous manners and partly because the surfacing treatment with the lubricant is performed by means of the inexpensive lime powder. Therefore, the process of the present invention can enjoy an advantage that the lubricating surface and the reinforcing lubricant have excellent coating properties because they are squeezed and pressure-applied by means of the dies.

The present invention will be described in detail in the following in connection with the examples thereof.

EXAMPLE 1

The drawing operation was conducted by using the wire drawing line or facilities having a construction similar to those of FIG. 1. The wire used was an As-rolled material made of 0.4% C carbon steel and having a diameter of 14.0 mm. This material wire was drawn under the following conditions:

(a) Descaling Condition

Shot blast was conducted by shooting steel balls having a mean diameter of 0.3 mm with a shooting density of about 300 kg/m$^2$.

(b) Lubricating Condition

The surfacing operation with a lubricant was conducted by the use of lime powder having a mean particle diameter of 15 microns. The reinforcing lubrication was conducted by the use of sodium stearate having a mean particle diameter of 12.5 microns. The pre-die lubrication was conducted by the use of a mixture of lime and calcium stearate.

(c) Drawing Condition

A drawn wire having a diameter of 11.6 mm was prepared at a running speed of 41 m/min. and in a reduction of area of 26.2% by using a drawing die having a die angle of $2\alpha=20$ degrees.

(d) Flaw Detecting Condition

The flow was detected at a phase angle of 130 degrees and with a frequency of 64 KHz by the use of a rotary probe type eddy current flaw detector.

The comparison between the drawing system of the present invention and a reference, in which only the pre-die lubrication was conducted, is presented in Table 1. In this Table, the die life indicates the drawing weight of the wire until the drawing die seizes, and freedom of the seizure means excellent lubrication of the wire.

TABLE 1

| | Lubricating Condition | Die Life |
|---|---|---|
| Ref. 1 | only C | 1,000–2,000 kg |
| Test 1 | A + C | 30,000–45,000 kg |
| Test 2 | A + B + C | 50,000–70,000 kg |

Wherein

A: Surfacing Treatment for Lubrication (with lime)

B: Lubricating Treatment for Reinforcement (with sodium stearate)

C: Pre-Die Lubricating Treatment

In view of the above Table 1, it is concluded that the productivity of drawing could be improved according to the present invention.

EXAMPLE 2

The drawing operation was conducted by the use of the line construction similar to that of FIG. 3. The bending roll unit used was constructed such that two series of five rolls having a diameter of 90 mm were arranged vertically and horizontally. The drawing weight of the wire by that roll bender was 10%. The results are tabulated in Table 2.

TABLE 2

| | Lubricating Condition | Die Life |
|---|---|---|
| Ref. 2 | only C | 1,500–3,000 kg |
| Test 3 | A + C | 40,000–60,000 kg |
| Test 4 | A + B + C | 55,000–70,000 kg |

wherein: A, B and C indicate those of the Table 1.

From the above results, it is found that the die life was improved as compared with that of the shot blast system of Example 1. This improvement was caused by the back tension which had been generated by the bending operation. By this operation of the bending roll, more specifically, a tension in the direction opposite to the running direction was applied to the wire 11. As a result, the surface pressure to be exerted upon the die 38 was so reduced that the life was improved.

EXAMPLE 3

The line construction was similar to that of the Example 2, but the drawing weight of the wire by the roll bender 24' was 32%, and the drawing step was conducted simultaneously with the descaling step. In operation, the material wire having a diameter of 14 mm was drawn to have a diameter of 12.2 mm in a reduction of area of 24%. As a result, another drawing step using a bored die reduced the area of the wire by about 10%, that it to say, the wire having the diameter of 12.2 mm was drawn to one having a diameter of 11.6 mm. The results are presented in Table 3 and reveal that the die life was remarkably improved thanks to further increase in the back tension.

TABLE 3

| | Lubricating Condition | Die Life |
|---|---|---|
| Ref. 3 | only C | 5,000–10,000 kg |
| Test 5 | A + C | 70,000–90,000 kg |
| Test 6 | A + B + C | 100,000–120,000 kg |

wherein: A, B and C also indicate those of Tables 1 and 2.

What is claimed is:

1. A dry type continuous wire drawing process comprising the following continuously conducted steps of:

feeding continuously a steel wire by unwinding the same from a pay-off stand;

mechanically descaling the continuously fed wire;

guiding and passing the descaled wire through a lubricant surfacer bath, a reinforcing lubricant bath and a pre-die lubricant bath, which baths are arranged in tandem in the recited order so that the wire runs therethrough continuously;

said lubricant surfacer bath containing therein a lime powder having a mean particle diameter not larger than 50 microns and having near an exit thereof a powder applying die having an internal diameter which is from 0.1 to 0.2 mm larger than the diameter of the descaled wire so as to permit application of a lime coating on the surface of the wire while said wire passes through said lubricant sufacer bath;

said reinforcing lubricant bath containing therein a sodium stearate powder having a mean particle diameter not smaller than 2 microns and having near an exit thereof a powder applying die having an internal diameter slightly larger than the diameter of the lime-coated wire so as to apply a coating of sodium stearate on the surface of the lime-coated wire while allowing the wire to run through said reinforcing lubricant bath;

said pre-die lubricant bath containing a calcium stearate powder for applying a coating of calcium stearate on the surface of the sodium stearate-coated wire, thereby forming three layers of coating on the surface of the descaled wire; and drawing the lubricant-coated wire through a drawing die.

2. The wire drawing process in accordance with claim 1, wherein said pre-die lubricant bath further contains a lime powder which is mixed with said calcium stearate powder.

3. The wire drawing process in accordance with claim 1, wherein the mechanical descaling process is conducted by shot-blasting the surface of the continuously fed steel wire.

4. The wire drawing process in accordance with claim 1, wherein the mechanical descaling process is conducted by bending the continuously fed steel wire.

5. The wire drawing process in accordance with claim 1, wherein the coating density of lime on the surface of the steel wire is not lower than 5 $g/mm^2$.

6. The wire drawing process in accordance with claim 1, wherein the coating density of sodium stearate on the surface of the lime-coated steel wire is not lower than 1 $g/mm^2$.

7. The wire drawing process in accordance with claim 1, wherein the coating density of calcium stearate on the surface of the lime and sodium stearate-coated steel wire is not lower than 2 $g/mm^2$.

* * * * *